US007240987B2

(12) United States Patent
Urech

(10) Patent No.: US 7,240,987 B2
(45) Date of Patent: Jul. 10, 2007

(54) INK JET PRINTING ASSEMBLY

(75) Inventor: Walter Urech, Hallwil (CH)

(73) Assignee: Systegra Ag, Solothurn (CH)

( * ) Notice: Subject to any disclaimer, the term of this patent is extended or adjusted under 35 U.S.C. 154(b) by 292 days.

(21) Appl. No.: 11/124,628

(22) Filed: May 5, 2005

(65) Prior Publication Data

US 2005/0264604 A1 Dec. 1, 2005

Related U.S. Application Data

(60) Provisional application No. 60/568,445, filed on May 5, 2004.

(51) Int. Cl.
*B41J 2/145* (2006.01)

(52) U.S. Cl. ..... 347/41; 347/10

(58) Field of Classification Search ..... 347/40, 347/41, 43

See application file for complete search history.

(56) References Cited

U.S. PATENT DOCUMENTS 6,328,418 B1 * 12/2001 Yamada et al. ..... 347/40
6,530,645 B2 * 3/2003 Haflinger ..... 347/41
6,575,558 B1 6/2003 Grose et al.
2003/0214554 A1 11/2003 Tschida

FOREIGN PATENT DOCUMENTS

EP 0963854 12/1999
EP 963854 A2 * 12/1999
EP 1293344 3/2003

* cited by examiner

*Primary Examiner*—Lamson Nguyen
*Assistant Examiner*—Justin Seo

(57) ABSTRACT

An ink jet printing assembly and method of use for printing on a substrate where the substrate is driven in a driving direction. The ink jet printing assembly includes a first jetting assembly having a first ink orifice and a second ink orifice and a second jetting assembly separate from the first jetting assembly having a third ink orifice. The third ink orifice is positioned between the first ink orifice and the second ink orifice in a cross substrate direction. A third jetting assembly, separate from the first and second jetting assemblies, includes a fourth ink orifice. The fourth ink orifice is aligned with the first ink orifice in the cross substrate direction. The fourth ink orifice is fired in an alternating relationship with the first ink orifice to define a generally consistent line of ink capable of minimizing the appearance of banding.

3 Claims, 4 Drawing Sheets

INK JET PRINTING ASSEMBLY

CROSS-REFERENCE TO RELATED APPLICATIONS

This application is a non-provisional of U.S. Provisional Application No. 60/568,445, filed on May 5, 2004. The disclosure of the above application is incorporated herein by reference.

FIELD OF THE INVENTION

The present invention relates to ink jet printing and, more particularly, relates to single-pass ink jet printing having an improved nozzle arrangement.

BACKGROUND OF THE INVENTION

Ink jet printing is extremely popular in a wide variety of industries. Typically, ink jet printing is accomplished through the use of a print head. The print head includes a plurality of orifices each capable of depositing an ink drop upon a substrate to form a predetermined pattern, such as an image, text, and the like. The plurality of orifices contained in the print head are arranged in rows and columns and are each capable of depositing an ink drop to a defined pixel position grid (also, defined as rows and columns) upon a substrate. This row and column arrangement of the orifices typically does not span the full number of rows or the full number of columns in the pixel position grid. Consequently, the print head and the substrate must be moved relative to each other to create the desired output to be printed.

As is known in the art, ink jet printing may be used in printing upon elongated substrates, such as paper rolls or sheets. To this end, the print head is often scanned or driven in a direction laterally across the substrate as the substrate is driven in a longitudinal direction. The substrate is typically stopped at predetermined steps according to separate encoding systems that accurately track the longitudinal movement of the substrate. Typically, at each step, a line of ink is deposition along a row of pixels, which is often referred to as a print line.

In low resolution printing, a first section of the image is printed across the substrate to define the entire row and a length of the columns. The substrate is then advanced a step and another entire row and an additional length of the columns is deposited. This process continues until the image is completed.

In high resolution printing, the density of the ink deposits in the pixel grid is increased to provide improved resolving power. To an extent, this can be achieved by manufacturing the print head with a single lateral line of more closely spaced orifices. However, it should be understood that there are limits to the minimum spacing between adjacent orifices that can be achieved with today's manufacturing systems.

Print heads can be made as wide as the area to be printed to promote single pass printing. In this arrangement, the substrate is moved longitudinally as the print head is held stationary. An entire row of ink is deposited at a time to provide the single pass capability.

Attempts have been made to improve the resolution of existing print head designs through the use of interlace configurations. Specifically, as seen in FIG. 1, these conventional designs employ a plurality of print heads that are arranged in multiple rows and overlapped or interlaced to stagger the print heads of each row relative to adjacent rows. In this regard, the resolution of the printing system is improved despite mechanical manufacturing limitations. However, these arrangement also suffer from a number of disadvantages, such as their sensitivity to yaw angle alignment of the substrate relative to the print head, the clumping of ink drops on non-absorbent substrates, and additionally the inability to nest adjacent print heads directly next to each other. These disadvantages will be discussed in further detail below.

SUMMARY OF THE INVENTION

According to the principles of the present invention, an ink jet printing assembly for printing on a substrate are provided having an advantageous construction and method of use. The substrate is driven in a driving direction. The ink jet printing assembly includes a first jetting assembly having a first ink orifice and a second ink orifice and a second jetting assembly separate from the first jetting assembly having a third ink orifice. The third ink orifice is positioned between the first ink orifice and the second ink orifice in a cross substrate direction. A third jetting assembly, separate from the first and second jetting assemblies, includes a fourth ink orifice. The fourth ink orifice is aligned with the first ink orifice in the cross substrate direction. The fourth ink orifice is fired in an alternating relationship with the first ink orifice to define a generally consistent line of ink capable of minimizing the appearance of banding.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

With particular reference to the figures, an ink jet printing assembly, generally indicated at 10, is provided having improved resolving capability, interchangeability, reduced overall size, in addition to many other benefits.

Figure 1:
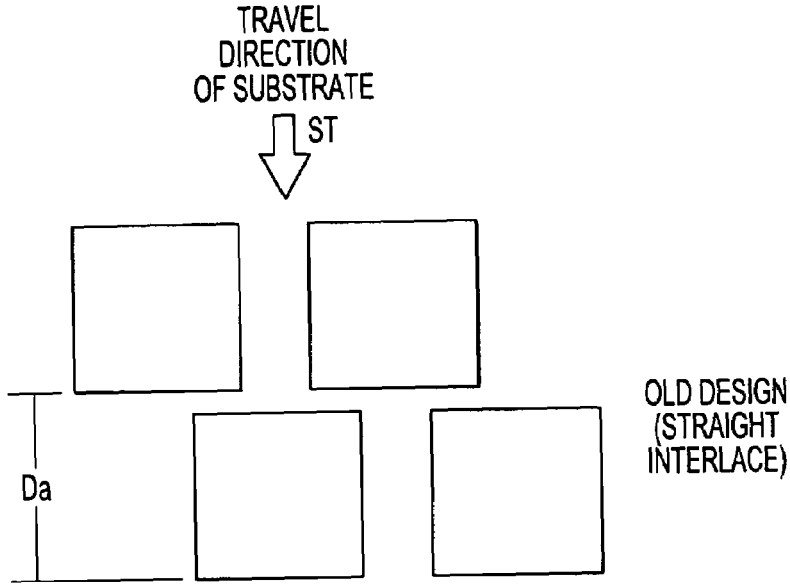
Fig-1 PRIOR ART
FIG. 1 is a schematic view illustrating the print head arrangement of a conventional straight interlace design.
Figure 2:
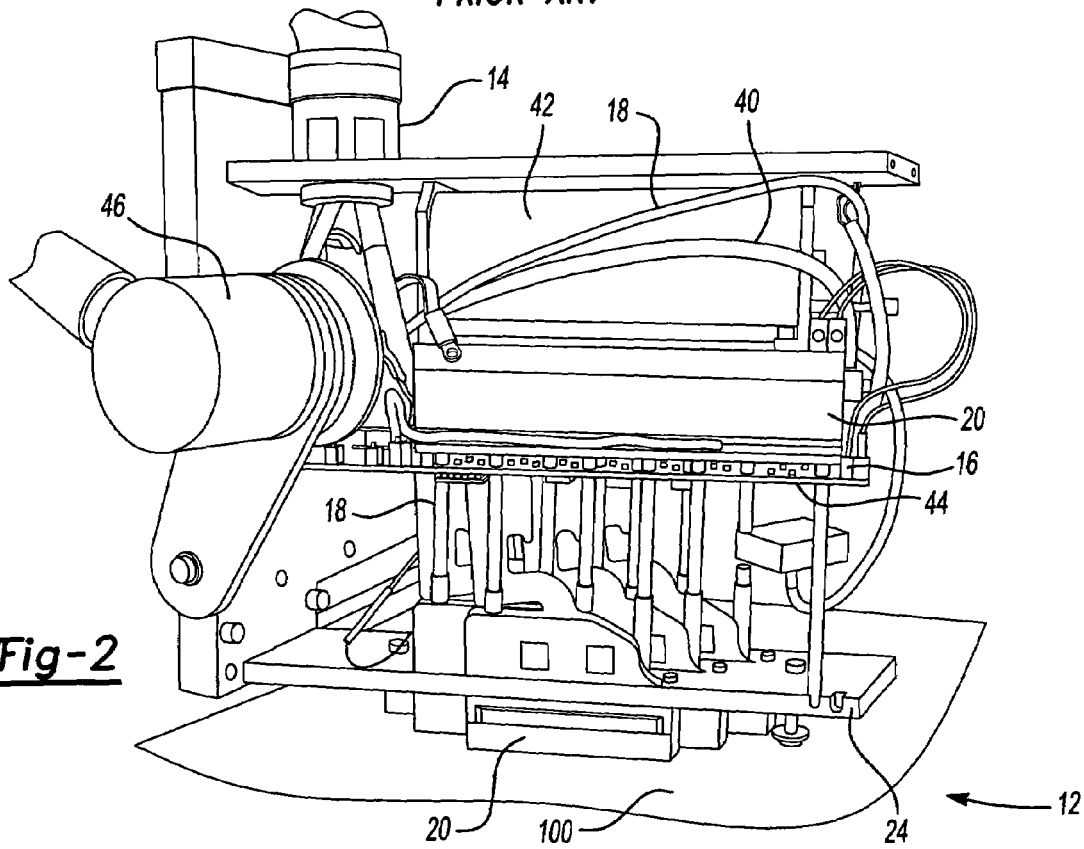
FIG. 2 is a perspective view illustrating the ink jet printing assembly according to the principles of the present invention.
Figure 3:
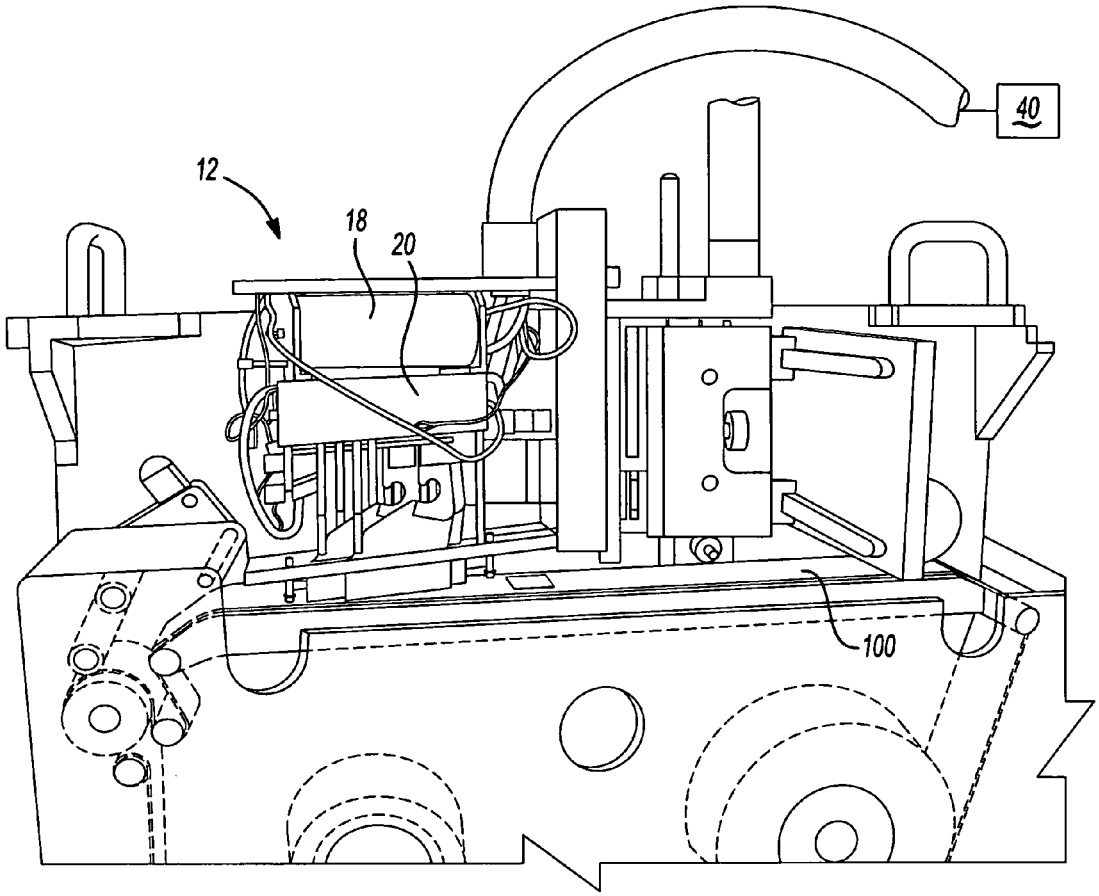
FIG. 3 is an environmental view illustrating the ink jet printing assembly according to the principles of the present invention.

As best seen in FIGS. 2 and 3, ink jet printing assembly 10 is part of an ink jet printing system 12. Ink jet printing system 12 generally includes an umbilical 14 that may be operably coupled to an ink supply, a control device, or any other off-board system. Umbilical 14 is further coupled to a mounting structure 16 adapted to carry the weight of the various components of ink jet printing system 12. An ink tube 18 is coupled between an onboard ink reservoir 20 and a plurality of jetting assemblies 22. A substrate 100, in this case a roll of material, is driven through a drive path ST (see FIGS. 1 and 5) as it travels through ink jet printing system 12 in a conventional manner.

Figure 4:
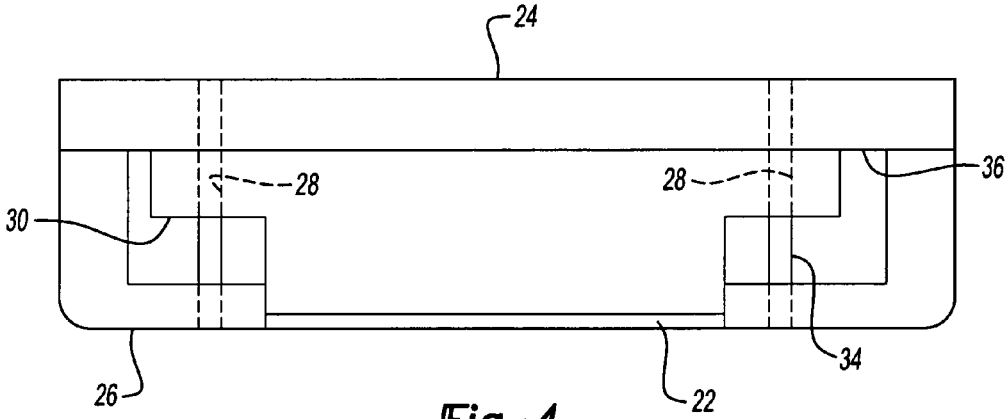
FIG. 4 is a cross sectional view illustrating the jetting assembly and mounting arrangement of the present invention.

Referring now to FIG. 4, each of the plurality of jetting assemblies 22 are fixedly, yet removably, coupled to mounting structure 16. Specifically, as seen in FIGS. 2 and 4, each of the plurality of jetting assemblies 22 are retained between a base plate 24 and a bottom plate 26. Base plate 24 is rigidly coupled to the remaining portions of mounting structure 16 to provide a reliable and solid mounting foundation. It should be understood that base plate 24 may be coupled to the remaining portions of mounting structure 16 according to any one of a number of known methods, such as welding, fasteners, and the like. Likewise, bottom plate 26 may be fastened to base plate 24 using conventional fasteners. It should be appreciated from the figures that bottom plate 26 preferably extends a distance beyond the end of each of the plurality of jetting assemblies 22. In this regard, any inadvertent contact of bottom plate 26 with substrate 100 or the underlying structure is passed directly to the mounting structure 16, thereby preventing damaging load forces and substrate fibers from damaging jetting assemblies 22. Accordingly, bottom plate 26 serves to protect jetting assemblies 22.

Each of the plurality of jetting assemblies 22 includes plurality of mounting holes 28 extending through a flange portion 30. The plurality of mounting holes 28 are preferably aligned relative to the plurality of mounting holes 28. To this end, it has been found that by using a microscope, adequate alignment of the plurality of mounting holes 28 to the plurality of orifices can be maintained. However, it should be understood that other manufacturing techniques may be use to insure the proper alignment of the plurality of mounting holes 28 to the plurality of orifices is maintained. A pin member 34 extends from bottom plate 26, through a corresponding one of the plurality of mounting holes 28, and into base plate 24. Pin member 34 serves to insure that each of the plurality of jetting assemblies 22 are positioned perpendicular to a face 36 of base plate 24 and additionally serves to insure that each of the plurality of jetting assemblies 22 are disposed in a predetermined position upon base plate 24 and, consequently, in a predetermined position relative to adjacent jetting assemblies 22.

Figure 5:
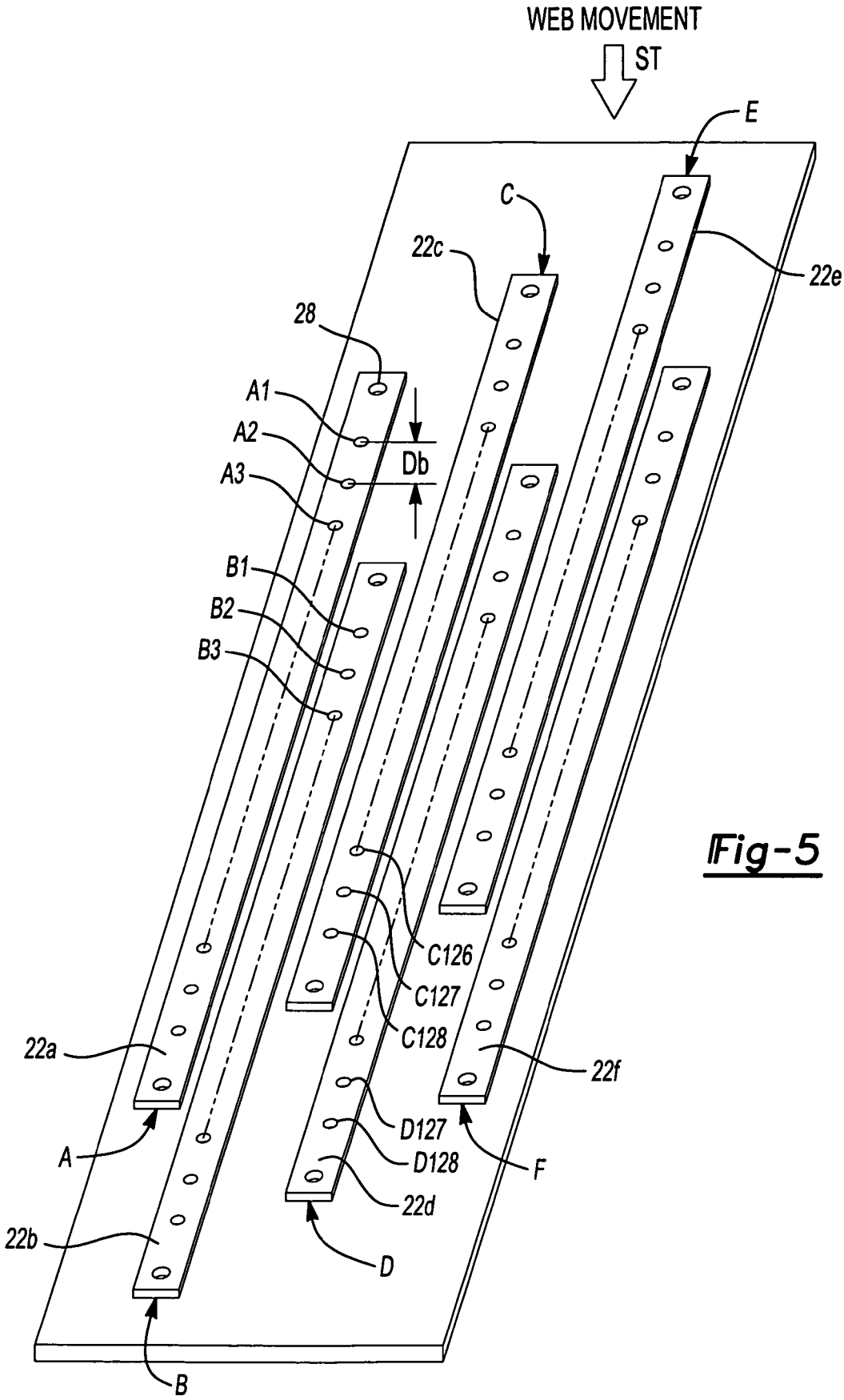
FIG. 5 is a plan view illustrating the positional relationship of the plurality of jetting assemblies of the present invention.

Briefly referring to FIG. 5, a plurality of jetting assemblies 22 are illustrates, generally labeled from A-F. The plurality of jetting assemblies 22A-F are arranged in a manner to provide efficient, reliable, and simple high-resolution image production. Each of the plurality of jetting assemblies 22A-F are preferably identical in construction and ink depositing operation. Accordingly, they may be discussed collectively as jetting assembly 22.

Still referring to FIG. 5, each of the plurality of jetting assemblies 22 includes a plurality of ink orifices, generally labeled as A1, A2, A3, etc. for jetting assembly 22A and similarly for the remaining jetting assemblies 22B-F. It should be appreciated that the present invention may be used with any number of jetting assemblies having any number of ink orifices. However, for the present discussion, six jetting assemblies 22A-F having ink orifices x1-x128 will be described where x represents either A-F.

The plurality of jetting assemblies 22A-F are arranged in an inclined relationship relative to a travel direction of substrate 100, generally indicated by the arrow at the top of FIG. 5. The specific angle of the plurality of jetting assemblies 22A-F is dependent upon the desired printing resolution and the spacing of adjacent ink orifices.

In operation, ink is pumped through a filter (not shown) and enters ink reservoir 20 through ink tube 18. The ink travels down ink tubes 18 to each of the plurality of jetting assemblies 22. A vacuum pump 38 creates a vacuum, preferably about 0.3 to 4 inches of water, that is transmitted through a vacuum tube 40 to a meniscus vacuum reservoir 42. This vacuum is in fluid communication with ink reservoir 20 through vacuum tube 40 to maintain a predetermined vacuum within ink reservoir 20. Such vacuum within ink reservoir 20 serves to prevent, or at least minimize, any dripping of ink from the plurality of jetting assemblies 22 upon a substrate 100.

In order to form the desired pattern, image, text, or the like, data from a controller is sent an integrated circuit board 44 and a control signal is output to an onboard controller or chip on each of the plurality of jetting assemblies 22. This control signal commands a firing of a specific ink orifice x1-x128, which produces an ink deposit upon substrate 100.

An encoder 46 is used to provide a timing signal to integrated circuit board 44. In other words, encoder 46 is capable of monitoring the drive movement of substrate 100 to provide the necessary position data for accurately firing of ink orifices x1-x128.

A high voltage (approx. 100V) is sent to integrate circuit board 44, which is transmits in the form of a control signal to each of the plurality of jetting assemblies 22. There is only one fire pulse signal sent to each jetting assembly 22. If a particular ink orifice should fire, then the data bit associated with this ink orifice is a one and the switch is closed. The data bit associated with the remaining ink orifices will remain a zero, thereby maintaining the corresponding switch (i.e. jetting assembly) is an opened state.

When the fire pulse is sensed by jetting assembly 22, jetting assembly 22 permits the fire pulse to pass therethrough to the associated ink orifice that is to be fired. The fire pulse causes a piezoelectric material in the ink jetting assembly 22 to expand thereby ejecting an ink drop from the corresponding ink orifice and depositing the ink drop upon a predetermined pixel on substrate 100.

Figure 6:
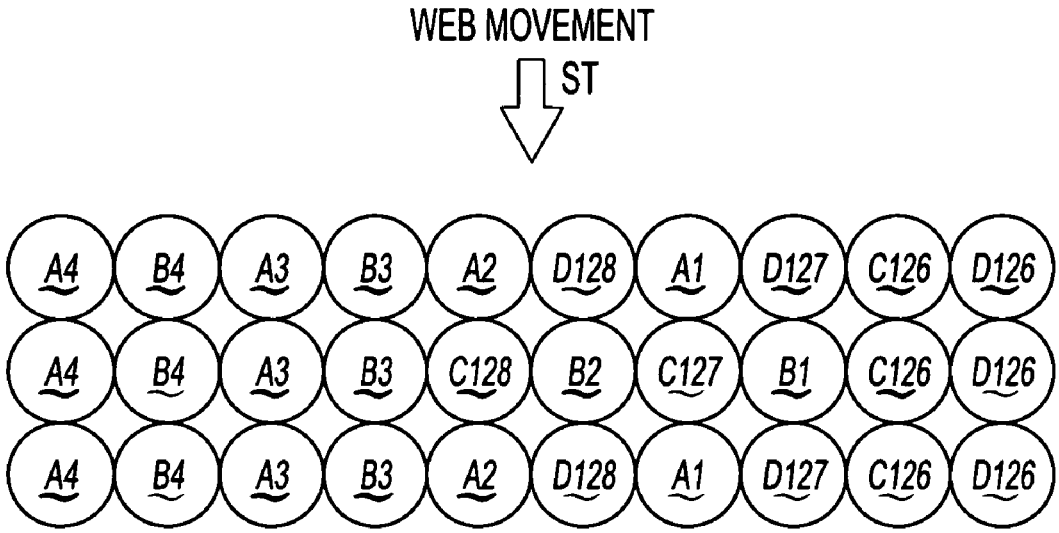
FIG. 6 is a plan view illustrating the ink drop deposition pattern upon the substrate according to the method of the present invention.

With particular reference to FIGS. 5 and 6, the process of ink deposit upon substrate 100 will now be discussed. As can be seen in FIG. 5, jetting assemblies 22A-F are arranged to provide a unique and useful deposition pattern and methodology. In the interest of brevity, only jetting assemblies 22A-D will be discussed. However, it should be appreciated that the same deposition pattern and method can be used for any number of jetting assemblies.

As described above, each jetting assembly 22 includes a plurality of ink orifices x1-x128 that output an ink drop in response to a fire pulse signal. However, it should be appreciated that it is anticipated that the plurality of ink orifices may be used to output variable size ink drops or variable number of ink drops to a single pixel location. Jetting assemblies 22 are arranged relative to substrate travel direction ST (indicated by the arrow in FIGS. 5 and 6) to form an interlace pattern. According to the present embodiment, ink orifice A2 is aligned with ink orifice C128 such that an ink drop dropped from ink orifice A2 could land directly on an ink drop dropped from ink orifice C128. However, in operation, ink orifices A2 and C128 alternate depositing an ink drop. Such alternating deposition of ink drops serves to overcome any potential misalignment of ink orifices A2 or C128 that would otherwise cause "banding" (i.e. gaps where no ink is deposited, yet is desired) in the final image on substrate 100.

As seen in FIG. 6, ink drops are preferably deposited in a manner to ensure proper coverage in the desired print area, thereby preventing or at least minimizing the occurrence of banding while providing improved resolution capability and resistance to misalignment problems. With particular reference to FIG. 5, the relative position of the plurality of ink orifices x1-x128 are illustrated between adjacent pairs of jetting assemblies, such as 22A/22B, 22C/22D, 22E/22F, etc. As can be seen, ink orifices A1-A128 are offset relative to ink orifices B1-B128 in an alternating pattern relative to substrate travel direction ST—specifically, B1 is disposed between A1 and A2, B2 is disposed between A2 and A3, or in other words Bx is disposed between Ax and Ax+1. A similar relationship of ink orifices exists between jetting assemblies 22C and 22D, etc. However, jetting assembly 22C is positioned relative to jetting assembly 22A such that ink orifices A2 and C128 are aligned relative to substrate travel direction ST (as are ink orifices A1 and C127, B1 and D127, B2 and D128, etc.). As can be seen in FIG. 6, which illustrates only a portion of the ink drop deposits in the print art, ink drops are deposited such that those ink orifices that are aligned from jetting assembly to jetting assembly are fired alternately to define an ink column 102. This ink column 102 is more resistant to misalignment of jetting assemblies as it serves to interrupt any potential banding.

The present invention provides a number of distinct advantages over the prior art, which will now be discussed, at least in part. As is known in the art, prior art interlace designs often suffer from yaw angle misalignment of the substrate. In other words, as seen in FIG. 1, if the substrate travel direction ST is yawed to one side or the conventional print heads are misaligned, the relative alignment of ink orifices is adversely effected, which causes banding. This condition is exacerbated as the distance Da (see FIG. 1), which represents the offset distance in the substrate travel direction ST, is increased.

In contrast, as seen in FIG. 5, the present invention overcomes this disadvantage through at least two different means. Specifically, any yaw angle error between each of the two jetting assemblies in each pair (i.e. jetting assembly 22A relative to jetting assembly 22B) is minimized as a result of the short offset distance Db in the substrate travel direction ST. Additionally, the negative effects of any yaw angle error between the pairs of jetting assemblies (i.e. jetting assembly pair 22A and 22B relative to jetting assembly pair 22C and 22D) is further minimized by the general alignment of ink orifices (i.e. ink orifice A2 and ink orifice C128) and the alternating firing of these aligned ink orifices. This arrangement eliminates the presence of banding and, at worst, causes only a checkerboard effect that is less apparent to a viewer's eye.

Furthermore, it is generally preferred to deposit ink drops laterally across substrate 100 in an alternating fashion—that is, deposit every other ink drop laterally to permit them to quickly spread. Additional ink drops are them deposited between the previous two to form a more uniform ink layer to prevent clumping. If ink drops are deposited next to each other, they tend to be drawn toward each other due to surface tension. This may result in clumping of drops, thereby resulting in banding. As described above, the present invention deposits every other ink drop initially before another ink drop is deposited therebetween. For example, ink drops from ink orifice A1 and A2 are first deposited apart from each other. A subsequent ink drop from ink orifice B1 is then deposited therebetween, providing a uniform ink layer.

Additionally, the present invention has the advantage of a compact design that permits a nested relationship of jetting assemblies 22A-F. Additionally, each of the jetting assemblies of the present invention can be mounted on a single rail or plate (i.e. base plate 24). Such mounting on a single member provides improved accuracy and simplified design. This arrangement also results in simpler adjustment of jetting assemblies. Additionally, because they are mounted on the same member, they are more likely to maintain alignment as they move.

Figure 7:
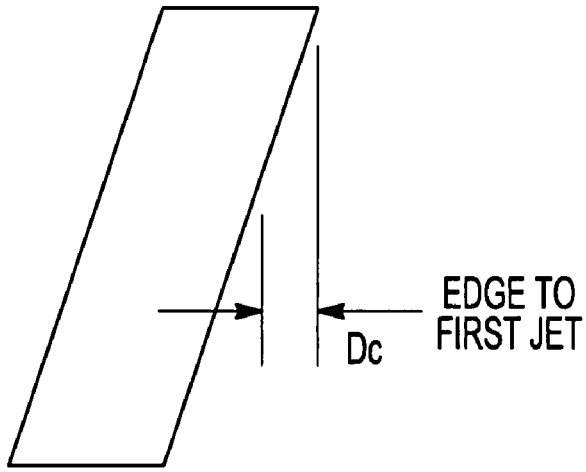
FIG. 7 is a schematic view illustrating the edge gap distance of the present invention.

Furthermore, it is often desirable to minimize the distance in the cross substrate direction (the direction orthogonal to substrate travel direction ST) between the edge of the jetting assembly and the ink orifice. By minimizing this distance, the jetting assembly may be positioned closer to edge obstructions, thereby minimizing the unprintable margin of substrate 100. In the present invention, as seen in FIG. 7, this distance Dc is smaller compared to convention straight interlace designs (see FIG. 1).

It is typically difficult to manufacture jetting assemblies without variation in the length from the first ink orifice (i.e. A1) to the last ink orifice (i.e. A128). This variation translates into significant ink drop placement variations in traditional straight interlace designs (see FIG. 1). However, the inclined arrangement of the jetting assemblies, the deposition of ink drops from one jetting assembly between ink drops deposited from another jetting assembly, and the alternating firing procedures of aligned ink orifices of the present invention described above serve to mask the errors from any such ink drop placement variations.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of printing on a substrate using an ink jet printing assembly, said ink jet printing assembly having a first jetting assembly having a first ink orifice and a second ink orifice, a second jetting assembly separate from said first jetting assembly, said second jetting assembly having a third ink orifice, said third ink orifice being positioned between said first ink orifice and said second ink orifice in a cross substrate direction and a third jetting assembly separate from said first and second jetting assemblies, said third jetting assembly having a fourth ink orifice, said method comprising:

driving said substrate in a driving direction, said substrate defining the cross substrate direction generally orthogonal to said driving direction;

depositing an ink drop from each of said first ink orifice and said second ink orifice of said first jetting assembly in said cross substrate direction;

depositing an ink drop from said third ink orifice of said second jetting assembly between said ink drops deposited from each of said first ink orifice and said second ink orifice; and alternating depositing an ink drop from each of said fourth ink orifice of said third jetting assembly and said first ink orifice of said first jetting assembly to form a generally consistent ink line in said driving direction.

2. The method according to claim 1, further comprising: positioning said first, second, and third jetting assemblies at an angle relative to the driving direction.

3. The method according to claim 1, further comprising: positioning said first, second, and third jetting assemblies generally parallel to each other.

* * * * *